US011278055B2

(12) United States Patent
Liu et al.

(10) Patent No.: US 11,278,055 B2
(45) Date of Patent: Mar. 22, 2022

(54) ULTRASONIC ELECTRONIC CIGARETTE ATOMIZER AND ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Yongquan Zhou, Hunan (CN)

(73) Assignee: CHINA TOBACCO HUMAN INDUSTRIAL CO., LTD., Hunan (CN)

( * ) Notice: Subject to any disclaimer, the term of this patent is extended or adjusted under 35 U.S.C. 154(b) by 190 days.

(21) Appl. No.: 16/622,753

(22) PCT Filed: May 16, 2018

(86) PCT No.: PCT/CN2018/087073

§ 371 (c)(1),
(2) Date: Dec. 13, 2019

(87) PCT Pub. No.: WO2018/228121

PCT Pub. Date: Dec. 20, 2018

(65) Prior Publication Data

US 2020/0178606 A1 Jun. 11, 2020

(30) Foreign Application Priority Data

Jun. 16, 2017 (CN) ..... 201720702178.X

(51) Int. Cl.
*A24F 40/48* (2020.01)
*A24F 40/05* (2020.01)
(Continued)

(52) U.S. Cl.
CPC ..... *A24F 40/05* (2020.01); *A24F 40/40* (2020.01); *A24F 40/46* (2020.01); *A24F 40/48* (2020.01); *A24F 40/10* (2020.01)

(58) Field of Classification Search
CPC ..... A24F 40/40; A24F 40/46; A24F 40/48; A24F 40/10
See application file for complete search history.

(56) References Cited

U.S. PATENT DOCUMENTS 10,506,827 B2 * 12/2019 Guo ..... A24F 40/70
2015/0007836 A1 * 1/2015 Li ..... A24F 40/485 131/329

(Continued)

FOREIGN PATENT DOCUMENTS

CN 105982363 A 10/2016
CN 106388009 A 2/2017

(Continued)

OTHER PUBLICATIONS

International Search Report issued in International Application No. PCT/CN2018/087073 dated Jul. 23, 2018, 3 pages.

*Primary Examiner* — Hae Moon Hyeon
(74) *Attorney, Agent, or Firm* — Mauriel Kapouytian Woods LLP; Michael Mauriel; Tzvi Hirshaut

(57) ABSTRACT

An ultrasonic electronic cigarette atomizer and electronic cigarette are disclosed. The atomizer includes an e-liquid storage assembly and an atomization core detachably connected to the e-liquid storage assembly. The atomization core includes an ultrasonic atomization sheet. The e-liquid storage assembly includes an e-liquid chamber and an e-liquid outlet for communicating an atomization surface of the ultrasonic atomization sheet with the e-liquid chamber. The e-liquid storage assembly further includes a moving assembly that can move in the direction of assembling/disassembling the atomization core to open/close the e-liq- (Continued)

uid outlet. When the atomization core is connected with the e-liquid storage assembly, the atomization core drives the moving assembly to move and open the e-liquid outlet. When the atomization core is disconnected from the e-liquid storage assembly, the moving assembly is reset and closes the e-liquid outlet.

19 Claims, 7 Drawing Sheets

(51) Int. Cl.

| | |
|---|---|
| ***A24F 40/46*** | (2020.01) |
| ***A24F 40/40*** | (2020.01) |
| *A24F 40/10* | (2020.01) |

(56) References Cited

U.S. PATENT DOCUMENTS

| | | | | |
|---|---|---|---|---|
| 2015/0164146 | A1* | 6/2015 | Li | A24F 40/485 131/329 |
| 2016/0366943 | A1* | 12/2016 | Li | A24F 40/485 |
| 2017/0049153 | A1 | 2/2017 | Guo et al. | |
| 2019/0053544 | A1* | 2/2019 | Yamada | A24F 40/42 |
| 2020/0146351 | A1* | 5/2020 | Rogan | A24F 40/485 |
| 2020/0187562 | A1* | 6/2020 | Rogan | A61M 15/06 |

FOREIGN PATENT DOCUMENTS

| | | | |
|---|---|---|---|
| CN | 205912902 | U | 2/2017 |
| CN | 205912905 | U | 2/2017 |
| CN | 206025225 | U | 3/2017 |
| CN | 206025226 | U | 3/2017 |
| CN | 206079025 | U | 4/2017 |
| CN | 206949542 | U | 2/2018 |

* cited by examiner

ULTRASONIC ELECTRONIC CIGARETTE ATOMIZER AND ELECTRONIC CIGARETTE

CROSS REFERENCE TO RELATED APPLICATIONS

This application is a U.S. National Phase application under 35 U.S.C. § 371 of International Application No. PCT/CN2018/087073 filed on May 16, 2018, which claims priority to Chinese Application Number 201720702178.X filed on Jun. 16, 2017. The entire contents of these applications are hereby incorporated herein by reference.

FIELD OF THE INVENTION

The present invention belongs to the technical field of electronic cigarettes, and particularly relates to an ultrasonic electronic cigarette atomizer and electronic cigarette.

BACKGROUND OF THE INVENTION

The existing ultrasonic electronic cigarette atomizer comprises an e-liquid storage assembly and an atomization core detachably connected to the e-liquid storage assembly, wherein the atomization core comprises an ultrasonic atomization sheet, and the e-liquid storage assembly comprises an e-liquid chamber and an e-liquid outlet for communicating an atomization surface of the ultrasonic atomization sheet with the e-liquid chamber.

The existing ultrasonic electronic cigarette atomizer has the following deficiencies:

First, when the atomization core is disassembled, e-liquid leakage may occur because the e-liquid outlet is not closed. After the atomization core is disassembled, e-liquid cannot be added to the e-liquid chamber (if added, e-liquid leakage will occur), so the atomizer is inconvenient to use and poor in user experience.

Second, when adding e-liquid, since the e-liquid outlet is not closed, even if the atomization core is not taken out at this time, leakage of the e-liquid to the surface of the ultrasonic atomization sheet easily occurs through the e-liquid outlet, the ultrasonic atomization sheet is immersed in the e-liquid, the atomization start speed is low, and the user easily sucks the e-liquid, resulting in poor user experience.

SUMMARY OF THE INVENTION

In the existing ultrasonic electronic cigarette atomizer, the e-liquid outlet cannot be closed when the atomization core is disassembled or when e-liquid is added, and e-liquid leakage easily occurs, so the user experience is poor. For the above deficiencies of the prior art, an objective of the present invention is to provide an ultrasonic electronic cigarette atomizer and electronic cigarette, in which the e-liquid outlet can be closed to prevent e-liquid leakage when the atomization core is disassembled or when e-liquid is added, so the user experience is good.

In order to solve the above technical problems, the technical solution adopted by the present invention is as follows:

An ultrasonic electronic cigarette atomizer, comprising an e-liquid storage assembly and an atomization core detachably connected to the e-liquid storage assembly, the atomization core comprising an ultrasonic atomization sheet, the e-liquid storage assembly comprising an e-liquid chamber and an e-liquid outlet for communicating an atomization surface of the ultrasonic atomization sheet with the e-liquid chamber, wherein the e-liquid storage assembly further comprises a moving assembly that can move in the direction of assembling/disassembling the atomization core to open/close the e-liquid outlet; when the atomization core is connected with the e-liquid storage assembly, the atomization core drives the moving assembly to move and open the e-liquid outlet; when the atomization core is disconnected from the e-liquid storage assembly, the moving assembly is reset and closes the e-liquid outlet.

With the above structure, when the atomization core is disassembled, the moving assembly moves in the disassembly direction along with the atomization core to block the e-liquid outlet, thereby preventing e-liquid leakage when the atomization core is taken out, and improving the utility of the atomizer. When the user disassembles the atomization core, if e-liquid needs to be added, since the moving assembly seals the e-liquid outlet, the e-liquid can also be added without leakage after the atomization core is disassembled. When the atomizer is in normal operation, the atomization core is assembled into the e-liquid storage assembly, and the atomization core drives the moving assembly to open the e-liquid outlet, so that the atomizer can be used normally.

Further, the e-liquid storage assembly comprises a housing; a first limiting seat and a rotating member are disposed in the housing, the e-liquid outlet is formed at the bottom of the side wall of the rotating member; the moving assembly comprises a moving member, the first limiting seat is sleeved on the rotating member, the first limiting seat is provided with a first limiting portion for limiting the rotating member, the side wall of the rotating member is provided with a through hole corresponding to the position of the first limiting portion, a reset spring is disposed in the through hole, one end of the reset spring abuts against the first limiting portion, the other end of the reset spring abuts against the head of an ejector pin, and the bottom of the ejector pin abuts against the moving member; when the atomization core is connected with the e-liquid storage assembly, the atomization core drives the moving member to compress the reset spring through the ejector pin and to open the e-liquid outlet; when the atomization core is disconnected from the e-liquid storage assembly, the reset spring is reset and the moving member is driven by the ejector pin to close the e-liquid outlet.

With the above structure, when the atomization core is unscrewed for disassembly, the ejector pin presses against the moving assembly under the action of the reset spring and causes the moving assembly to move down until the moving assembly seals the e-liquid outlet, only then can the atomization core be completely taken out, thereby preventing the e-liquid from leaking out of the e-liquid outlet during the process of taking out the atomization core. When the atomization core is connected with the e-liquid storage assembly, the reset spring is in a compressed state, the moving assembly does not block the e-liquid outlet, and the e-liquid in the e-liquid chamber can flow into the atomization core for atomization.

Further, the moving assembly further comprises a second limiting seat, the second limiting seat is sleeved in the rotating member, the top of the moving member is sleeved in the bottom of the rotating member, and the inner side wall of the rotating member is provided with a second limiting portion for limiting the second limiting seat.

The second limit portion can prevent the moving assembly from exceeding the travel range of downward movement.

Further, the atomizer further comprises an upper cover assembly detachably connected to the e-liquid storage assembly; the atomization core comprises an e-liquid inlet communicated with the atomization surface of the ultrasonic atomization sheet; when e-liquid is injected, the rotating member is driven by the upper cover assembly to rotate so that the e-liquid outlet is misaligned with the e-liquid inlet to block the e-liquid channel; after the e-liquid is injected, the rotating member is driven by the upper cover assembly to rotate so that the e-liquid outlet is communicated with the e-liquid inlet to open the e-liquid channel.

Further, the e-liquid storage assembly comprises an upper fixing seat on the top of the housing, the upper fixing seat is provided with an e-liquid injection hole communicated with the e-liquid chamber, the upper fixing seat is also provided with a limiting slot, and the top of the first limiting seat is provided with limiting lugs corresponding to the limiting slot.

The limiting lugs are inserted into the limiting slot to rotate within a certain angle range, thereby driving the rotating member to rotate and sealing the e-liquid outlet to prevent e-liquid leakage when the upper cover assembly is taken down to add e-liquid. When the e-liquid is added, the upper cover assembly is rotated, the rotating member is rotated along with the upper cover member by a certain angle until the limiting lugs are clamped in the limiting slot, the e-liquid outlet on the rotating member is misaligned with the e-liquid inlet on the atomization core to seal the e-liquid inlet, and e-liquid leakage does not occur when the upper cover assembly is unscrewed for adding the e-liquid, thereby increasing the utility of the atomizer and the convenience for the user.

Further, the upper cover assembly comprises a nozzle holder for sealing the upper fixing seat, a nozzle communicated with the atomization surface of the ultrasonic atomization sheet is fixed on the nozzle holder, and the nozzle holder is provided with an air inlet communicated with the atomization surface of the ultrasonic atomization sheet.

Further, the side wall of the second limiting seat is provided with an air passing hole communicated with the atomization surface of the ultrasonic atomization sheet; when the atomization core is connected with the e-liquid storage assembly, the atomization core drives the second limiting seat to move through the moving member until the air passing hole is communicated with the air inlet; when the atomization core is disconnected from the e-liquid storage assembly, the moving member drives the second limiting seat to move so as to cut off the communication between the air passing hole and the air inlet.

With the above structure, when the atomization core is disassembled, the moving assembly not only blocks the e-liquid outlet, but also blocks the air inlet through the second limiting seat, and the atomizer cannot operate at this time, thereby preventing smoking when the atomization core is not assembled, and preventing the service life of the ultrasonic atomization sheet from being shortened by dry burning. When the atomization core is assembled, the through hole is communicated with the air inlet, so that the air channel is opened, and smoking can be normally performed.

Further, the side wall of the second limiting seat is provided with an annular groove corresponding to the position of the air passing hole.

Since the annular groove is provided, when the upper cover assembly is taken out to add e-liquid, the air channel is opened in the case where the atomization core is not taken out.

As a preferred mode, the atomization core comprises an upper assembly and a lower assembly that are detachably connected, the upper assembly comprises an upper connecting seat and an e-liquid guide structure in the upper connecting seat, the lower assembly comprises a lower connecting seat and the ultrasonic atomization sheet in the lower connecting seat, and the upper connecting seat is detachably connected with the lower connecting seat; when the upper assembly is connected with the lower assembly, the e-liquid guide structure communicates the atomization surface of the ultrasonic atomization sheet with the e-liquid chamber.

The upper and lower assemblies are detachable and replaceable, which reduces the cost of use and is convenient and practical.

Based on the same inventive concept, the present invention further provides an electronic cigarette, comprising the ultrasonic electronic cigarette atomizer.

Compared with the prior art, the e-liquid channel of the present invention can be cut off when the atomization core is disassembled or when e-liquid is added, so that e-liquid leakage is prevented, and the product has long service life and good user experience.

In which, 1 e-liquid storage assembly, 2 atomization core, 3 ultrasonic atomization sheet, 4 e-liquid chamber, 5 e-liquid outlet, 6 moving assembly, 7 housing, 8 first limiting seat, 9 rotating member, 10 moving member, 11 first limiting portion, 12 through hole, 13 reset spring, 14 ejector pin, 15 second limiting seat, 16 second limiting portion, 17 upper cover assembly, 18 e-liquid inlet, 19 upper fixing seat, 20 e-liquid injection hole, 21 limiting slot, 22 limiting lug, 23 nozzle holder, 24 nozzle, 25 air inlet, 26 air passing hole, 27 annular groove, 28 upper assembly, 29 lower assembly, 30 upper connecting seat, 31 lower connecting seat, 32 connecting thread seat, 33 first gasket, 34 support spring, 35 inner sleeve, 36 outer sleeve, 37 e-liquid storage cotton, 38 atomization cotton, 39 second gasket, 40 seal ring, 41 silicone seat, 42 insulating ring, 43 small electrode, 44 lower fixing seat, 45 third gasket, 46 air inlet tube.

DETAILED DESCRIPTION OF EMBODIMENTS

Figure 1:
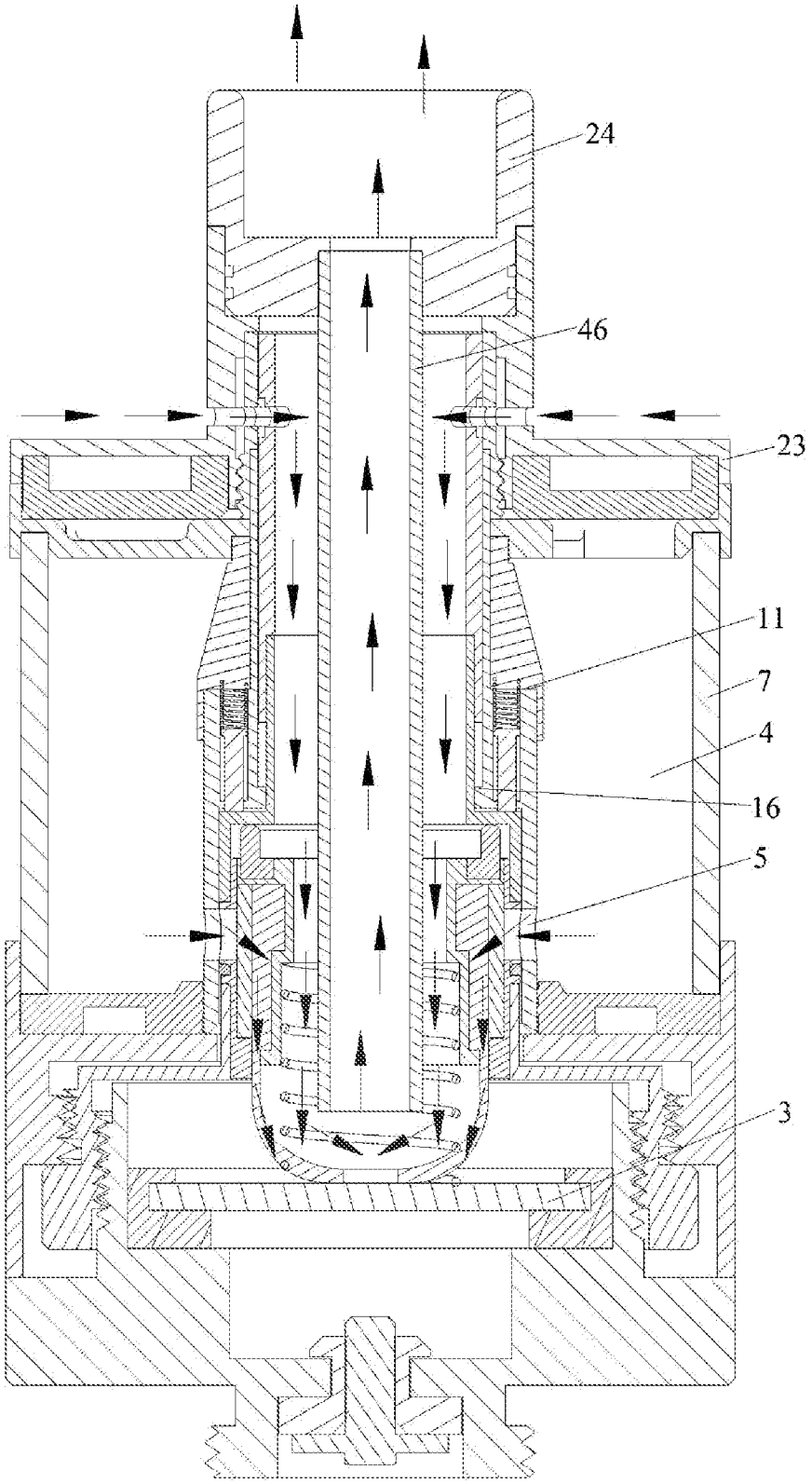
FIG. 1 is a structural schematic diagram of the present invention in a use state.
Figure 2:
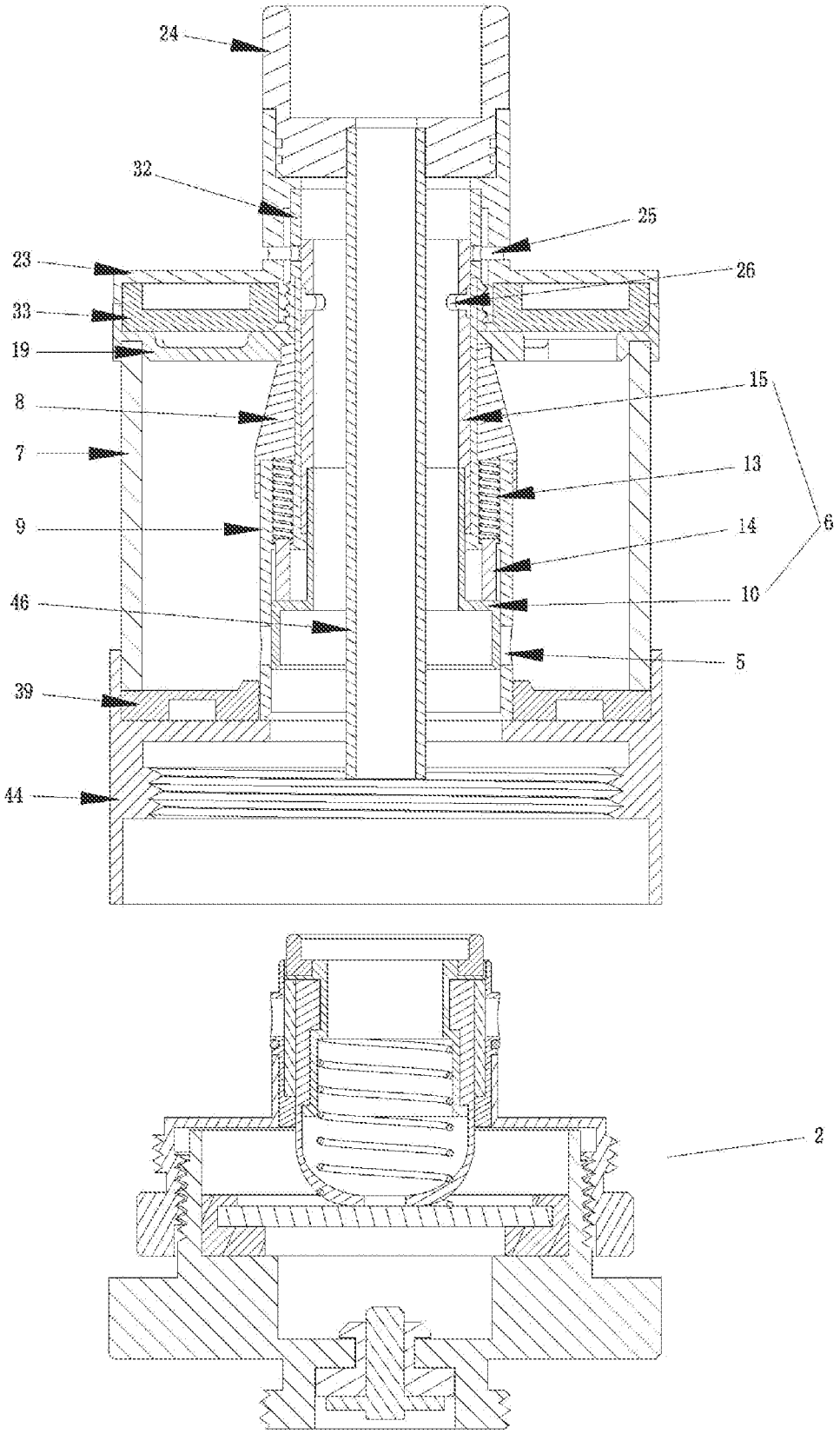
FIG. 2 is an exploded view of components after an atomization core is disassembled.
Figure 3:
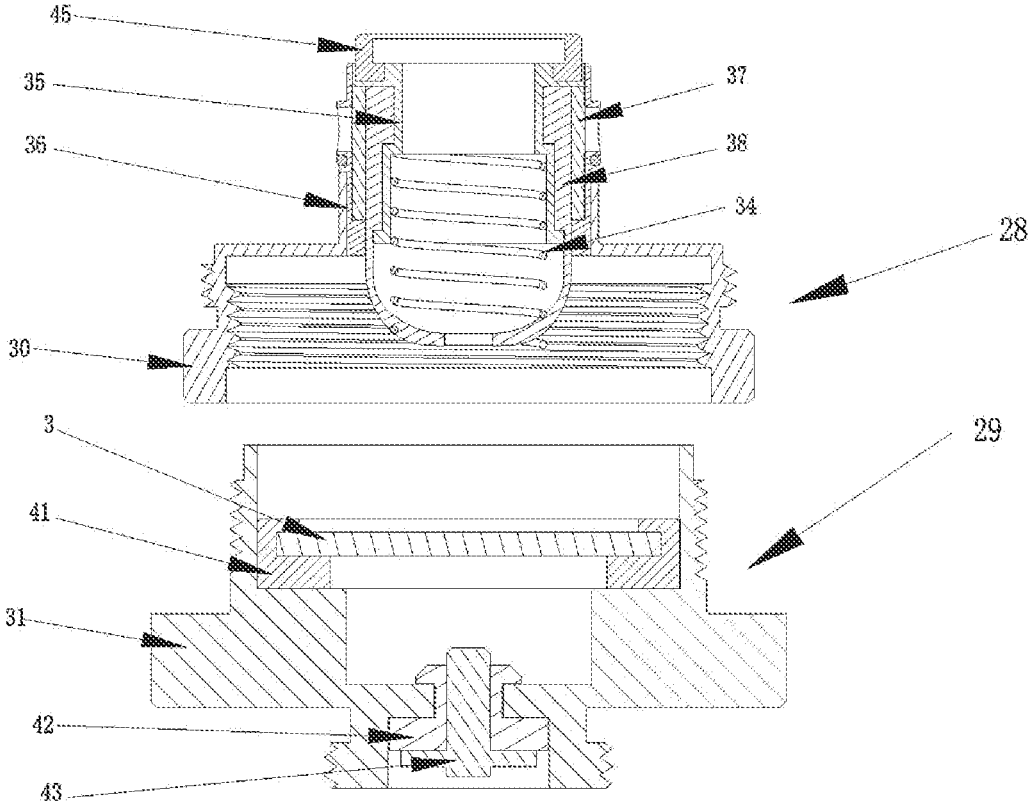
FIG. 3 is an exploded view of components of the atomization core.
Figure 4:
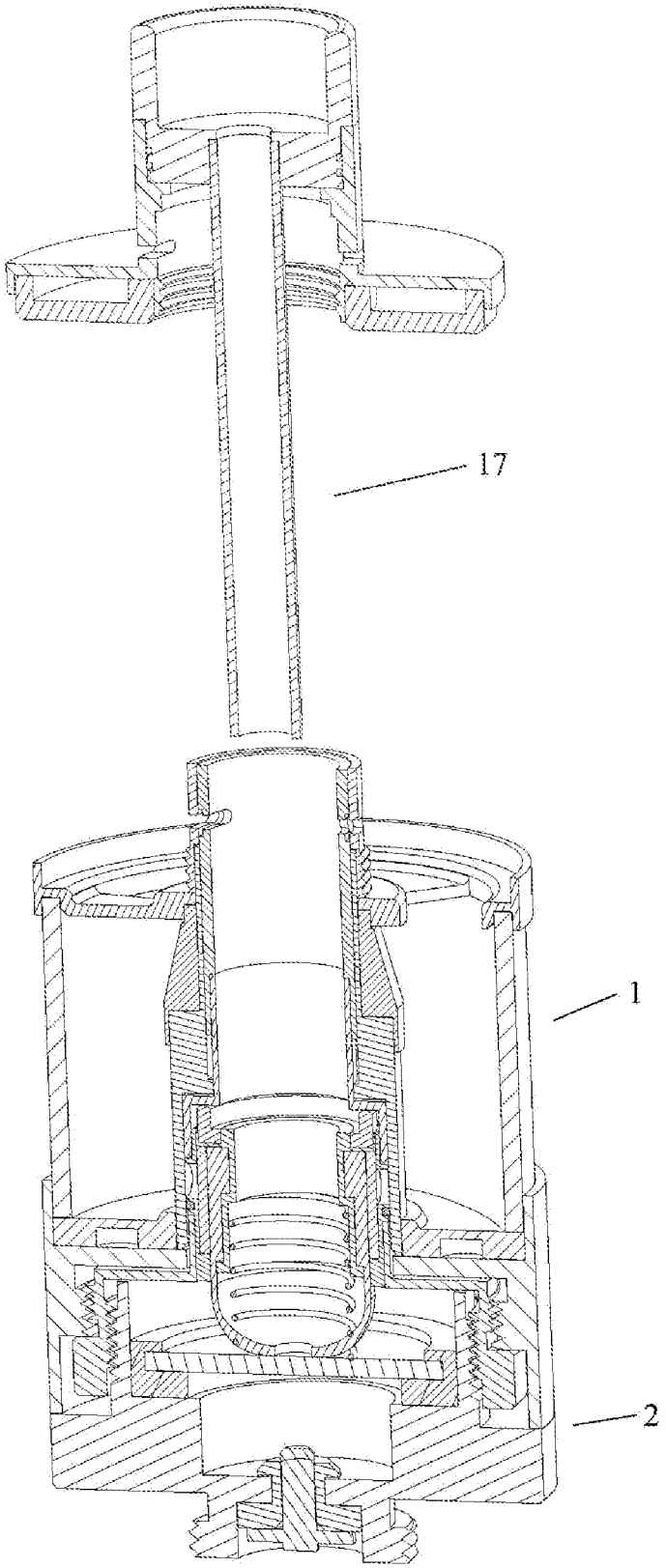
FIG. 4 is an exploded view of components after an upper cover assembly is disassembled.
Figure 5:
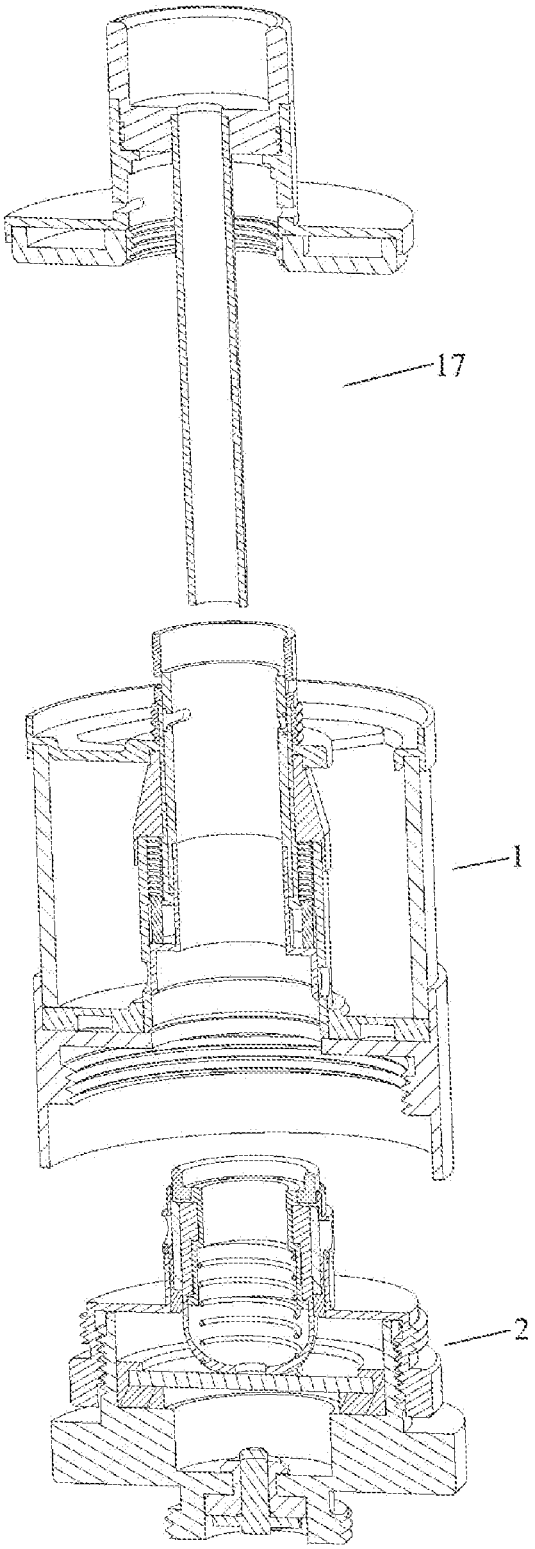
FIG. 5 is an exploded view of components of the upper cover assembly, an e-liquid storage assembly and the atomization core.
Figure 6:
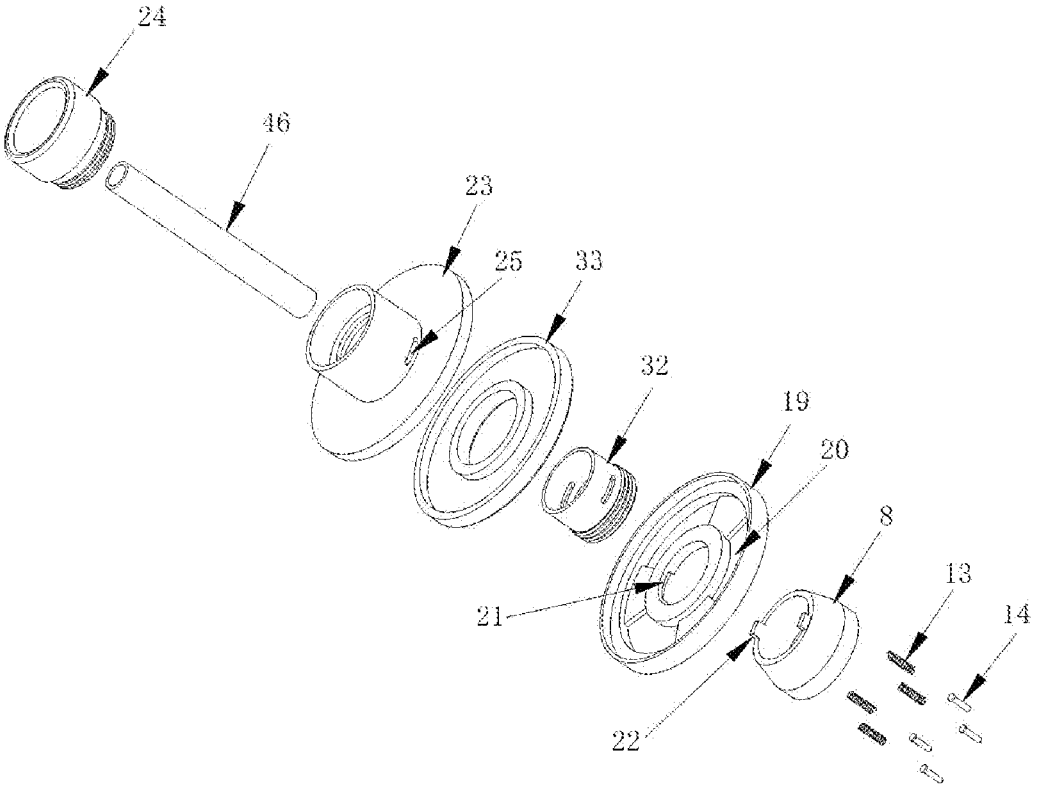
FIG. 6 is the upper part of an exploded view of the present invention.
Figure 7:
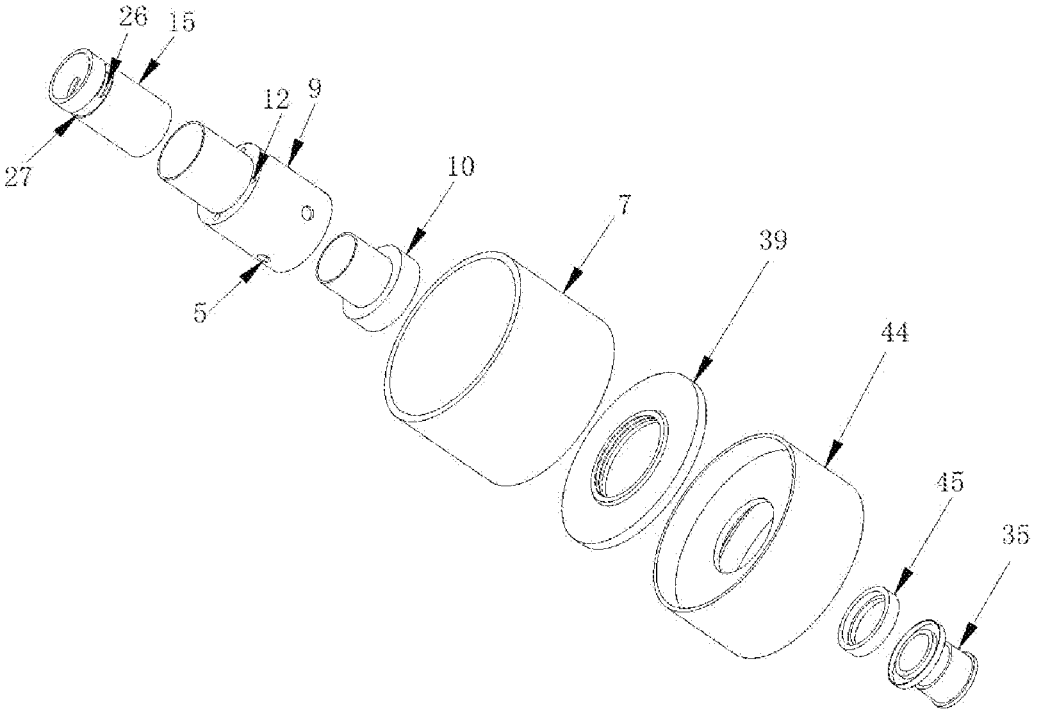
FIG. 7 is the middle part of the exploded view of the present invention.
Figure 8:
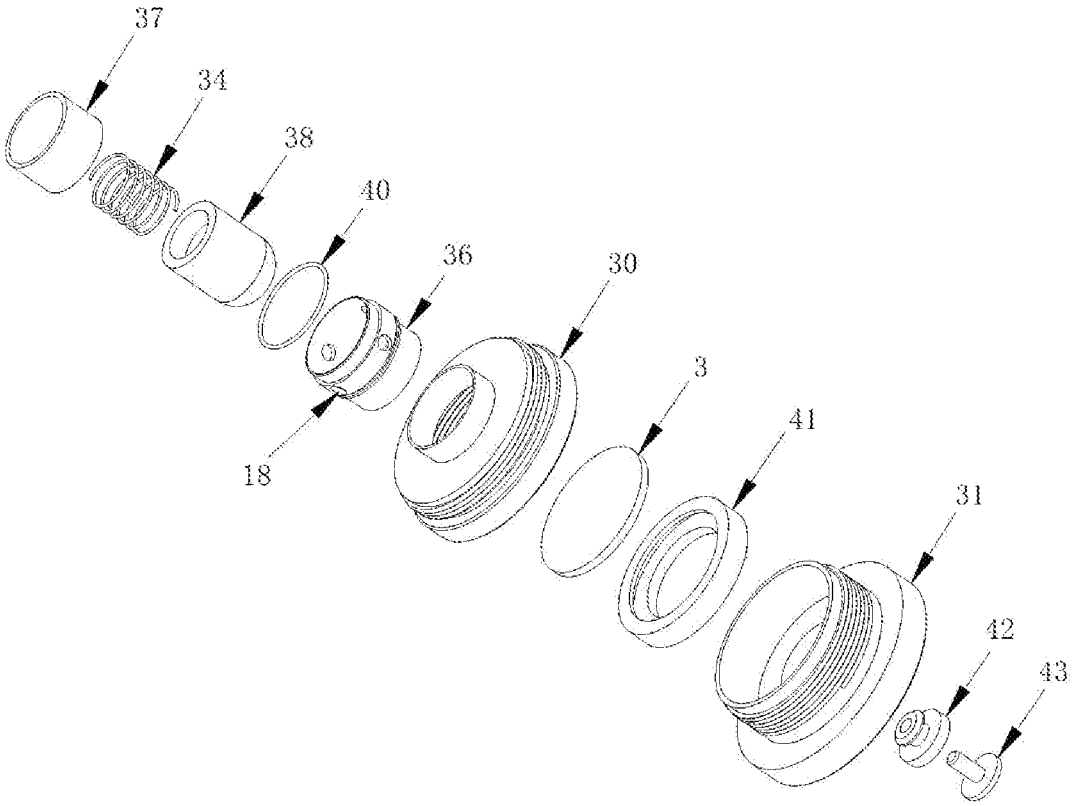
FIG. 8 is the lower part of the exploded view of the present invention.

As shown in FIG. 1 to FIG. 8, in an embodiment of an electronic cigarette of the present invention, the ultrasonic electronic cigarette atomizer comprises an e-liquid storage assembly 1 and an atomization core 2 detachably connected to the e-liquid storage assembly 1, the atomization core 2 comprises an ultrasonic atomization sheet 3, the e-liquid storage assembly 1 comprises an e-liquid chamber 4 and an e-liquid outlet 5 for communicating an atomization surface of the ultrasonic atomization sheet 3 with the e-liquid chamber 4, and the e-liquid storage assembly 1 further comprises a moving assembly 6 that can move in the direction of assembling/disassembling the atomization core 2 to open/close the e-liquid outlet 5; when the atomization core 2 is connected with the e-liquid storage assembly 1, the atomization core 2 drives the moving assembly 6 to move and open the e-liquid outlet 5; when the atomization core 2 is disconnected from the e-liquid storage assembly 1, the moving assembly 6 is reset and closes the e-liquid outlet 5.

The e-liquid storage assembly 1 comprises a housing 7; a first limiting seat 8 and a rotating member 9 are disposed in the housing 7, the e-liquid outlet 5 is formed at the bottom of the side wall of the rotating member 9; the moving assembly 6 comprises a moving member 10, the first limiting seat 8 is sleeved on the rotating member 9, the first limiting seat 8 is provided with a first limiting portion 11 for limiting the rotating member 9, the side wall of the rotating member 9 is provided with a through hole 12 corresponding to the first limiting portion 11, a reset spring 13 is disposed in the through hole 12, one end of the reset spring 13 abuts against the first limiting portion 11, the other end of the reset spring 13 abuts against the head of an ejector pin 14, and the bottom of the ejector pin 14 abuts against the moving member 10; when the atomization core 2 is connected with the e-liquid storage assembly 1, the atomization core 2 drives the moving member 10 to compress the reset spring 13 through the ejector pin 14 and to open the e-liquid outlet 5; when the atomization core 2 is disconnected from the e-liquid storage assembly 1, the reset spring 13 is reset and the moving member 10 is driven by the ejector pin 14 to close the e-liquid outlet 5.

The moving assembly 6 further comprises a second limiting seat 15, the second limiting seat 15 is sleeved in the rotating member 9, the top of the moving member 10 is sleeved in the bottom of the rotating member 9, and the inner side wall of the rotating member 9 is provided with a second limiting portion 16 for limiting the second limiting seat 15.

The atomizer further comprises an upper cover assembly 17 detachably connected to the e-liquid storage assembly 1; the atomization core 2 comprises an e-liquid inlet 18 communicated with the atomization surface of the ultrasonic atomization sheet 3; when e-liquid is injected, the rotating member 9 is driven by the upper cover assembly 17 to rotate so that the e-liquid outlet 5 is misaligned with the e-liquid inlet 18; after the e-liquid is injected, the rotating member 9 is driven by the upper cover assembly 17 to rotate so that the e-liquid outlet 5 is communicated with the e-liquid inlet 18.

The e-liquid storage assembly 1 comprises an upper fixing seat 19 on the top of the housing 7, the upper fixing seat 19 is provided with an e-liquid injection hole 20 communicated with the e-liquid chamber 4, the upper fixing seat 19 is also provided with a limiting slot 21, and the top of the first limiting seat 8 is provided with limiting lugs 22 corresponding to the limiting slot 21.

The upper cover assembly 17 comprises a nozzle holder 23 for sealing the upper fixing seat 19, a nozzle 24 communicated with the atomization surface of the ultrasonic atomization sheet 3 is fixed on the nozzle holder 23, and the nozzle holder 23 is provided with an air inlet 25 communicated with the atomization surface of the ultrasonic atomization sheet 3. The nozzle 24 is communicated with the ultrasonic atomization sheet 3 through an air inlet tube 46.

The top end of the rotating member 9 is sleeved with a connecting thread seat 32, and the e-liquid storage assembly 1 is screwed to the nozzle holder 23 through the connecting thread seat 32. A first gasket 33 is disposed between the nozzle holder 23 and the upper fixing seat 19.

The side wall of the second limiting seat 15 is provided with an air passing hole 26 communicated with the atomization surface of the ultrasonic atomization sheet 3; when the atomization core 2 is connected with the e-liquid storage assembly 1, the atomization core 2 drives the second limiting seat 15 to move through the moving member 10 until the air passing hole 26 is communicated with the air inlet 25; when the atomization core 2 is disconnected from the e-liquid storage assembly 1, the moving member 10 drives the second limiting seat 15 to move so as to cut off the communication between the air passing hole 26 and the air inlet 25.

The side wall of the second limiting seat 15 is provided with an annular groove 27 corresponding to the position of the air passing hole 26.

The atomization core 2 comprises an upper assembly 28 and a lower assembly 29 that are detachably connected, the upper assembly 28 comprises an upper connecting seat 30 and an e-liquid guide structure in the upper connecting seat 30, the lower assembly 29 comprises a lower connecting seat 31 and the ultrasonic atomization sheet 3 in the lower connecting seat 31, and the upper connecting seat 30 is detachably connected with the lower connecting seat 31; when the upper assembly 28 is connected with the lower assembly 29, the e-liquid guide structure communicates the atomization surface of the ultrasonic atomization sheet 3 with the e-liquid chamber 4.

A lower fixing seat 44 is disposed at the bottom of the housing 7, and the upper connecting seat 30 is screwed to the lower fixing seat 44. A second gasket 39 is disposed between the lower fixing seat 44 and the housing 7.

The upper assembly 28 further comprises a support spring 34, an inner sleeve 35 and an outer sleeve 36 that are connected in a sleeved way, and the outer sleeve 36 is disposed in the top of the upper connecting seat 30. The e-liquid guide structure comprises an e-liquid storage cotton 37 and an atomization cotton 38, the side wall of the atomization cotton 38 is sleeved between the inner sleeve 35 and the outer sleeve 36, and the e-liquid storage cotton 37 is sleeved on the side wall of the atomization cotton 38 and communicated with the e-liquid chamber 4 through the e-liquid inlet 18. The top end of the support spring 34 abuts against the inner side wall of the inner sleeve 35, and the bottom end of the support spring 34 abuts against the inner bottom surface of the atomization cotton 38. A third gasket 45 is disposed on the top of the inner sleeve 35. A seal ring 40 is sleeved under the e-liquid inlet 18 of the outer sleeve 36.

The lower assembly 29 further comprises a silicone seat 41 in the lower connecting seat 31, an insulating ring 42, and a small electrode 43. The ultrasonic atomization sheet 3 is disposed and fixed on the silicone seat 41. The small electrode 43 is disposed at the bottom of the lower connecting seat 31, and the small electrode 43 is connected to the lower connecting seat 31 in an insulation way by the insulating ring 42.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An ultrasonic electronic cigarette atomizer, comprising an e-liquid storage assembly (1) and an atomization core (2) detachably connected to the e-liquid storage assembly (1), wherein the atomization core (2) comprises an ultrasonic atomization sheet (3), wherein the e-liquid storage assembly (1) comprises an e-liquid chamber (4) and an e-liquid outlet (5) for communicating an atomization surface of the ultrasonic atomization sheet (3) with the e-liquid chamber (4), wherein the e-liquid storage assembly (1) further comprises a moving assembly (6) that can move in the direction of assembling/disassembling the atomization core (2) to open/close the e-liquid outlet (5); when the atomization core (2) is connected with the e-liquid storage assembly (1), the atomization core (2) drives the moving assembly (6) to move and open the e-liquid outlet (5); and when the atomization core (2) is disconnected from the e-liquid storage assembly (1), the moving assembly (6) is reset and closes the e-liquid outlet (5); wherein the e-liquid storage assembly (1) comprises a housing (7), a first limiting seat (8), and a rotating member (9) that are disposed in the housing (7), wherein the e-liquid outlet (5) is formed at the bottom of the side wall of the rotating member (9), wherein the moving assembly (6) comprises a moving member (10), wherein the first limiting seat (8) is sleeved on the rotating member (9), wherein the first limiting seat (8) is provided with a first limiting portion (11) for limiting the rotating member (9), wherein the side wall of the rotating member (9) is provided with a through hole (12) corresponding to the position of the first limiting portion (11), wherein a reset spring (13) is disposed in the through hole (12), wherein one end of the reset spring (13) abuts against the first limiting portion (11), wherein the other end of the reset spring (13) abuts against the head of an ejector pin (14), and wherein the bottom of the ejector pin (14) abuts against the moving member (10); when the atomization core (2) is connected with the e-liquid storage assembly (1), the atomization core (2) drives the moving member (10) to compress the reset spring (13) through the ejector pin (14) and to open the e-liquid outlet (5); and when the atomization core (2) is disconnected from the e-liquid storage assembly (1), the reset spring (13) is reset and the moving member (10) is driven by the ejector pin (14) to close the e-liquid outlet (5).

2. The ultrasonic electronic cigarette atomizer according to claim 1, wherein the moving assembly (6) further comprises a second limiting seat (15), wherein the second limiting seat (15) is sleeved in the rotating member (9), wherein the top of the moving member (10) is sleeved in the bottom of the rotating member (9), and wherein the inner side wall of the rotating member (9) is provided with a second limiting portion (16) for limiting the second limiting seat (15).

3. The ultrasonic electronic cigarette atomizer according to claim 2, further comprising an upper cover assembly (17) detachably connected to the e-liquid storage assembly (1); wherein the atomization core (2) comprises an e-liquid inlet (18) communicated with the atomization surface of the ultrasonic atomization sheet (3); when e-liquid is injected, the rotating member (9) is driven by the upper cover assembly (17) to rotate so that the e-liquid outlet (5) is misaligned with the e-liquid inlet (18); and after the e-liquid is injected, the rotating member (9) is driven by the upper cover assembly (17) to rotate so that the e-liquid outlet (5) is communicated with the e-liquid inlet (18).

4. The ultrasonic electronic cigarette atomizer according to claim 3, wherein the e-liquid storage assembly (1) comprises an upper fixing seat (19) on the top of the housing (7), wherein the upper fixing seat (19) is provided with an e-liquid injection hole (20) communicated with the e-liquid chamber (4), wherein the upper fixing seat (19) is also provided with a limiting slot (21), and wherein the top of the first limiting seat (8) is provided with limiting lugs (22) corresponding to the limiting slot (21).

5. The ultrasonic electronic cigarette atomizer according to claim 4, wherein the upper cover assembly (17) comprises a nozzle holder (23) for sealing the upper fixing seat (19), wherein a nozzle (24) communicated with the atomization surface of the ultrasonic atomization sheet (3) is fixed on the nozzle holder (23), and wherein the nozzle holder (23) is provided with an air inlet (25) communicated with the atomization surface of the ultrasonic atomization sheet (3).

6. The ultrasonic electronic cigarette atomizer according to claim 5, wherein the side wall of the second limiting seat (15) is provided with an air passing hole (26) communicated with the atomization surface of the ultrasonic atomization sheet (3); when the atomization core (2) is connected with the e-liquid storage assembly (1), the atomization core (2) drives the second limiting seat (15) to move through the moving member (10) until the air passing hole (26) is communicated with the air inlet (25); and when the atomization core (2) is disconnected from the e-liquid storage assembly (1), the moving member (10) drives the second limiting seat (15) to move so as to cut off the communication between the air passing hole (26) and the air inlet (25).

7. The ultrasonic electronic cigarette atomizer according to claim 6, wherein the side wall of the second limiting seat (15) is provided with an annular groove (27) corresponding to the position of the air passing hole (26).

8. The ultrasonic electronic cigarette atomizer according to claim 7, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

9. The ultrasonic electronic cigarette atomizer according to claim 2, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

10. The ultrasonic electronic cigarette atomizer according to claim 3, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

11. The ultrasonic electronic cigarette atomizer according to claim 4, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

12. The ultrasonic electronic cigarette atomizer according to claim 5, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

13. The ultrasonic electronic cigarette atomizer according to claim 6, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

14. The ultrasonic electronic cigarette atomizer according to claim 1, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

15. The ultrasonic electronic cigarette atomizer according to claim 1, wherein the atomization core (2) comprises an upper assembly (28) and a lower assembly (29) that are detachably connected, wherein the upper assembly (28) comprises an upper connecting seat (30) and an e-liquid guide structure in the upper connecting seat (30), wherein the lower assembly (29) comprises a lower connecting seat (31) and the ultrasonic atomization sheet (3) in the lower connecting seat (31), and wherein the upper connecting seat (30) is detachably connected with the lower connecting seat (31); and when the upper assembly (28) is connected with the lower assembly (29), the e-liquid guide structure communicates the atomization surface of the ultrasonic atomization sheet (3) with the e-liquid chamber (4).

16. An electronic cigarette, comprising the ultrasonic electronic cigarette atomizer according to claim 1.

17. The electronic cigarette according to claim 16, wherein the e-liquid storage assembly (1) comprises a housing (7), a first limiting seat (8), and a rotating member (9) that are disposed in the housing (7), wherein the e-liquid outlet (5) is formed at the bottom of the side wall of the rotating member (9), wherein the moving assembly (6) comprises a moving member (10), wherein the first limiting seat (8) is sleeved on the rotating member (9), wherein the first limiting seat (8) is provided with a first limiting portion (11) for limiting the rotating member (9), wherein the side wall of the rotating member (9) is provided with a through hole (12) corresponding to the position of the first limiting portion (11), wherein a reset spring (13) is disposed in the through hole (12), wherein one end of the reset spring (13) abuts against the first limiting portion (11), wherein the other end of the reset spring (13) abuts against the head of an ejector pin (14), and wherein the bottom of the ejector pin (14) abuts against the moving member (10); when the atomization core (2) is connected with the e-liquid storage assembly (1), the atomization core (2) drives the moving member (10) to compress the reset spring (13) through the ejector pin (14) and to open the e-liquid outlet (5); and when the atomization core (2) is disconnected from the e-liquid storage assembly (1), the reset spring (13) is reset and the moving member (10) is driven by the ejector pin (14) to close the e-liquid outlet (5).

18. The electronic cigarette according to claim 17, wherein the moving assembly (6) further comprises a second limiting seat (15), wherein the second limiting seat (15) is sleeved in the rotating member (9), wherein the top of the moving member (10) is sleeved in the bottom of the rotating member (9), and wherein the inner side wall of the rotating member (9) is provided with a second limiting portion (16) for limiting the second limiting seat (15).

19. The electronic cigarette according to claim 18, further comprising an upper cover assembly (17) detachably connected to the e-liquid storage assembly (1); wherein the atomization core (2) comprises an e-liquid inlet (18) communicated with the atomization surface of the ultrasonic atomization sheet (3); when e-liquid is injected, the rotating member (9) is driven by the upper cover assembly (17) to rotate so that the e-liquid outlet (5) is misaligned with the e-liquid inlet to block the e-liquid channel; and after the e-liquid is injected, the rotating member (9) is driven by the upper cover assembly (17) to rotate so that the e-liquid outlet (5) is communicated with the e-liquid inlet to open the e-liquid channel.

* * * * *